US006715806B2

(12) United States Patent
Arlt et al.

(10) Patent No.: US 6,715,806 B2
(45) Date of Patent: Apr. 6, 2004

(54) MOTOR VEHICLE DOOR LOCK WITH A LOCK UNIT AND A CONTROL UNIT WHICH ARE SEPARATED FROM ONE ANOTHER

(75) Inventors: Horst Arlt, Wuelfrath (DE); Bernd Weyerstall, Wuppertal (DE); Stefan Josten, Remscheid (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/270,721

(22) Filed: Oct. 16, 2002

(65) Prior Publication Data

US 2004/0004357 A1 Jan. 8, 2004

(30) Foreign Application Priority Data

Oct. 16, 2001 (DE) ..... 201 21 438 U
Jul. 5, 2002 (DE) ..... 102 30 584

(51) Int. Cl.[7] ..... E05C 3/06
(52) U.S. Cl. ..... 292/201; 292/DIG. 23
(58) Field of Search ..... 292/216, 201, 292/DIG. 23; 49/279, 280

(56) References Cited

U.S. PATENT DOCUMENTS 4,342,209 A * 8/1982 Kleefeldt ..... 70/264
4,487,441 A * 12/1984 Miyamoto ..... 292/336.3
5,234,237 A * 8/1993 Gergoe ..... 292/201
5,263,751 A * 11/1993 Priest ..... 292/336.3
5,666,834 A 9/1997 Inoue
6,045,168 A 4/2000 Johnson et al.
6,050,117 A 4/2000 Weyerstall
6,168,216 B1 * 1/2001 Nakajima ..... 292/201
6,398,271 B1 * 6/2002 Tomaszewski ..... 292/216
6,409,233 B1 * 6/2002 Hanaki ..... 292/144

FOREIGN PATENT DOCUMENTS

DE 10 63 926 8/1959
DE 44 44 581 A1 6/1995
DE 198 44 778 A1 4/2000
EP 0894 920 A1 2/1999
EP 0 894 920 A1 3/1999
FR 2 825 402 A1 12/2002

* cited by examiner

*Primary Examiner*—Gary Estremsky
(74) *Attorney, Agent, or Firm*—Nixon Peabody LLP; David S. Safran

(57) ABSTRACT

A motor vehicle door lock with mechanical lock elements in a lock unit, with a lock mechanism, with several interacting elements in a control unit which is separated from the lock unit, optionally with lock electronics in the control unit , and the lock unit being arranged spatially separate from the control unit in or on a motor vehicle door or hatch, the lock unit being connected to the control unit by a remote power transmission, and the lock element in the lock unit, by the remote power transmission, is mechanically actuated from an element of the lock mechanism in the control unit. Reaching of the locked position or the main catch position of the lock latch is mechanically signaled to the control unit by the drawing function of the remote power transmission.

17 Claims, 5 Drawing Sheets

MOTOR VEHICLE DOOR LOCK WITH A LOCK UNIT AND A CONTROL UNIT WHICH ARE SEPARATED FROM ONE ANOTHER

BACKGROUND OF THE INVENTION

1. Field of the Invention

This invention relates to a motor vehicle door lock. More specifically, the present invention relates to a door lock with a control unit separate from a lock unit.

The concept of motor vehicle door lock of this invention should be understood as encompassing not only side door locks and rear door locks, but also, for example, rear hatch locks. The concept of motor vehicle door lock of the present invention means the entire system with components that can also be arranged in a distributed manner.

2. Description of Related Art

Motor vehicle door locks are known in various embodiments. More and more often, motor vehicle door locks can be found with a central interlock drive, opening drive, auxiliary lock drive, driven entirely by electric motor. One example of such a motor vehicle door lock system can be found in published European Patent Application EP 0 894 920 A1, which includes lock elements and lock mechanism having a plurality of micro-switches and proximity sensors, especially Hall sensors, with signals which are evaluated and converted in the lock electronics.

In particular, in the lock mechanism and the lock electronics, the issue of moisture entry is important. The above-mentioned known motor vehicle door lock relates to special shielding measures.

A motor vehicle door or hatch has a damp space facing the outside door wall in which moisture enters from above at the window shaft in an amount that is often considerable, and a dry space that is generally sealed and separated from the damp space and is facing toward the inside of the motor vehicle door or hatch. The lock elements necessarily sit in the damp space as they are normally located on the end face of the motor vehicle door or hatch. In the dry space, there are electrical components such as, for example, a speaker, etc. The damp space/dry space separation has become known in, for example, electrical window raisers.

Also, as shown in published German Patent Application DE 44 44 581 A1, damp space/dry space separation has also been applied in a motor vehicle door lock. In this motor vehicle door lock there are mechanical lock elements, including lock latch and the detent pawl, combined in one lock unit in an encapsulated housing located in a damp space. In a dry space, on the other hand, a lock unit connected via Bowden cables to a separate control unit with an electric drive motor and lock electronics. In the dry space, there is also the inside door handle arrangement. The use of a remote power transmission means, such as the Bowden cable, which penetrates the damp/dry separation of the motor vehicle door or hatch, makes it possible to house the moisture-sensitive control unit in the dry space without adversely affecting the serviceability of the motor vehicle door lock overall.

In the above-discussed published prior art, not less than five mechanical connections by the remote power transmission means and an undisclosed number of electrical connection elements are necessary, especially for interrogation and supply of sensors for scanning the position of the lock latch or the like. Accordingly, the associated cost is considerable with such door lock systems which prevents practical introduction of these motor vehicle door locks.

SUMMARY OF THE INVENTION

It is therefore an object of the invention is to optimize the above explained known concept of damp space/dry space separation for a motor vehicle door lock.

In an embodiment of the invention, the information of the locked position or the main catch position of the lock latch is transmitted mechanically via the remote power transmission means to the control unit. In this embodiment, the motion of the lock latch into the closed position or the main catch position exerts an actuating force on the remote power transmission means, and the motion of the remote power transmission means resulting therefrom can be evaluated by circuitry in the control unit. In doing so, the lock element, especially the detent pawl, is actuated by means of a drawing function of the remote power transmission means in the first direction. By means of the drawing function of the remote power transmission means in a second direction opposite the first direction, reaching the locked position or the main catch position of the lock latch is mechanically signaled.

This results in the desired scanning of the position of the lock latch that can be routed to the control unit by an existing connecting element, specifically the remote power transmission means. An electrical connecting element between the lock unit and the control unit can be abandoned in this regard.

In another embodiment, the remote power transmission means is coupled to the lock element, i.e., the detent pawl, with an inclusion of a bilateral freewheel. This arrangement allows the lock latch a certain overstroke with the detent pawl already engaged and optionally allows trailing engagement for the detent pawl when the motor vehicle door lock is closed.

To be able to recognize reaching of the locked position or the main catch position of the lock latch by the motion of the remote power transmission means in the control unit as reliably as possible, it is desirable for the motion of the remote power transmission means which is to be detected to be much greater than all inaccuracies caused by tolerances, etc. Generally, this motion will also be much greater than the possible deflection of the detent pawl so that a correspondingly large freewheel must be provided.

A large freewheel means that, when the lock latch is in the locked position or in the main catch position for raising the detent pawl, fundamentally the existing freewheel must be "bridged." This is especially a problem in that the actuating forces on the outside door handle and on the inside door handle should be as small as possible in order to achieve maximum ease of use. These small actuating forces can generally be implemented by corresponding multiplication so that a low activation force is "bought" at the cost of a large actuating stroke. It is obvious that the aforementioned freewheel is problematical.

In yet another embodiment, a large movement of the remote power transmission means can be accomplished compared to the lifting motion of the detent pawl without having to tolerate a freewheel. When the lock latch is in the locked position or the main catch position the actuating force on the remote power transmission means directly causes an actuating force on the detent pawl. The freewheel is largely avoided by an adjustable intermediate element which is dynamically coupled to the lock latch.

The invention is further described below using several embodiments shown in the drawings.

DETAILED DESCRIPTION OF THE INVENTION

Figure 1:
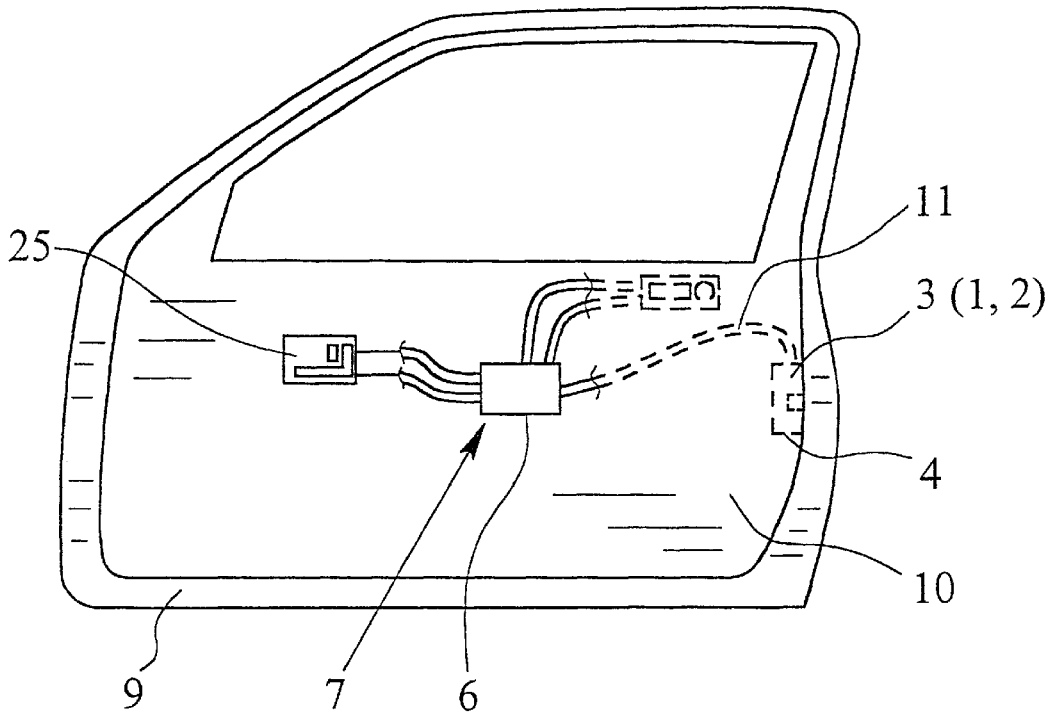
FIG. 1 schematically shows a two-part motor vehicle door lock with a lock unit in the damp space and the control unit separate from it in the dry space.
Figure 2:
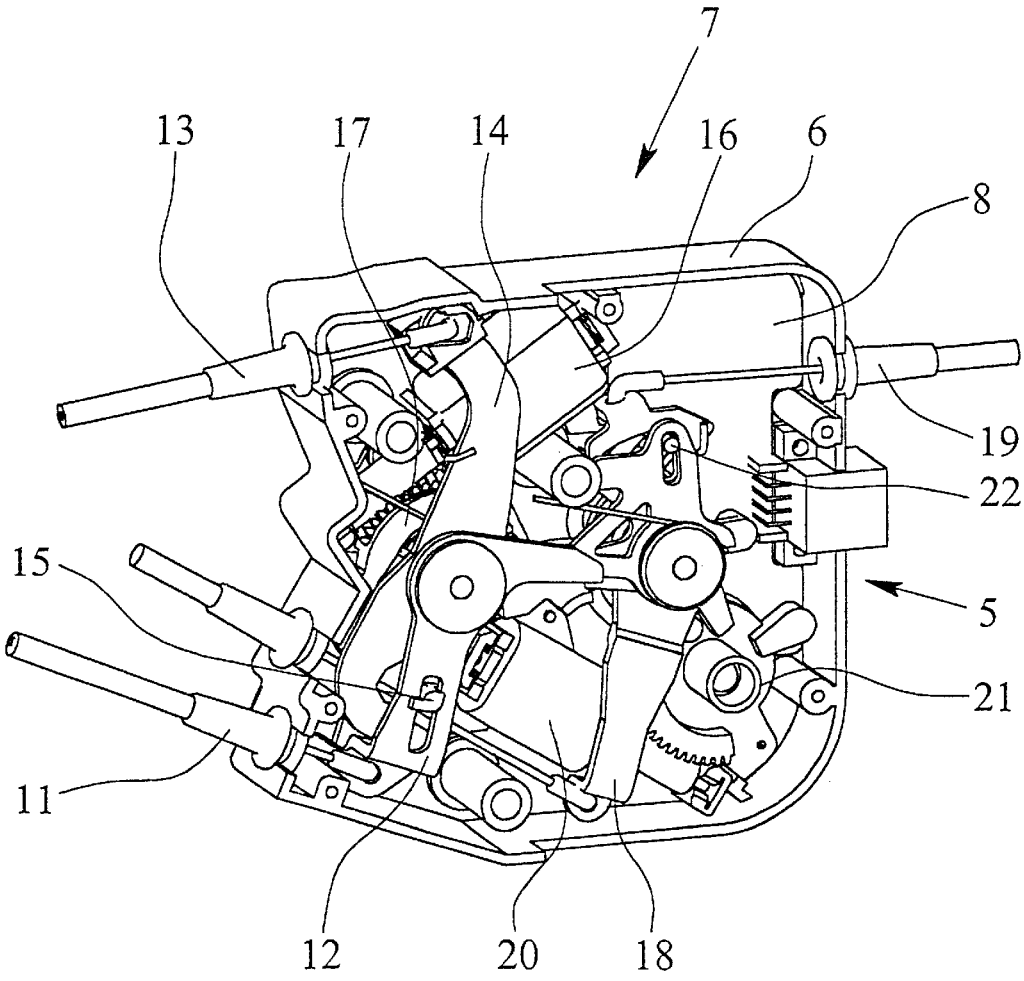
FIG. 2 shows a representation of a especially preferred version of the control unit of a motor vehicle door lock as shown in FIG. 1.

FIG. 1 shows the basic concept of this invention, specifically a motor vehicle door lock with mechanical lock elements 1, 2, especially a lock latch 1 and detent pawl 2, in a lock unit 3 located in a housing 4 which protects against the entry of moisture. Furthermore, FIG. 1 shows a housing 6, which houses a lock mechanism 5 shown in details in FIG. 2. FIG. 2 shows that lock mechanism 5 generally has several interacting elements. This arrangement forms a control unit 7 which is spatially separate from the lock unit 3.

The motor vehicle door lock shown schematically in FIG. 1 is shown using the example of a motor vehicle side door lock. Also rear door locks, sliding door locks, hatch locks, or the like are encompassed and covered by this concept of a door lock of this present invention.

As shown in FIG. 2, as previously indicated, there can be lock electronics 8 in the control unit 7. The lock electronics are generally on a board which is inserted in the housing 6 of the control unit 7. In the control unit 7, there are also the necessary microswitches, sensors, etc.

As previously mentioned, FIG. 1 illustrates that the lock unit 3 is spaced apart from the control unit 7 in the motor vehicle door or hatch 9, and the lock unit 3 with the lock elements 1, 2 in the damp space on the end face of the motor vehicle door or hatch 9, the control unit 7, on the other hand, is located on the other side of the damp/dry separation 10 in the dry space of the motor vehicle door or hatch 9.

The above-described distributed arrangement of the components of the motor vehicle door lock has the aforementioned advantages, especially with respect to protection of the sensitive mechanical elements of the lock mechanism 5 and the lock electronics 8 against moisture.

Figure 3:
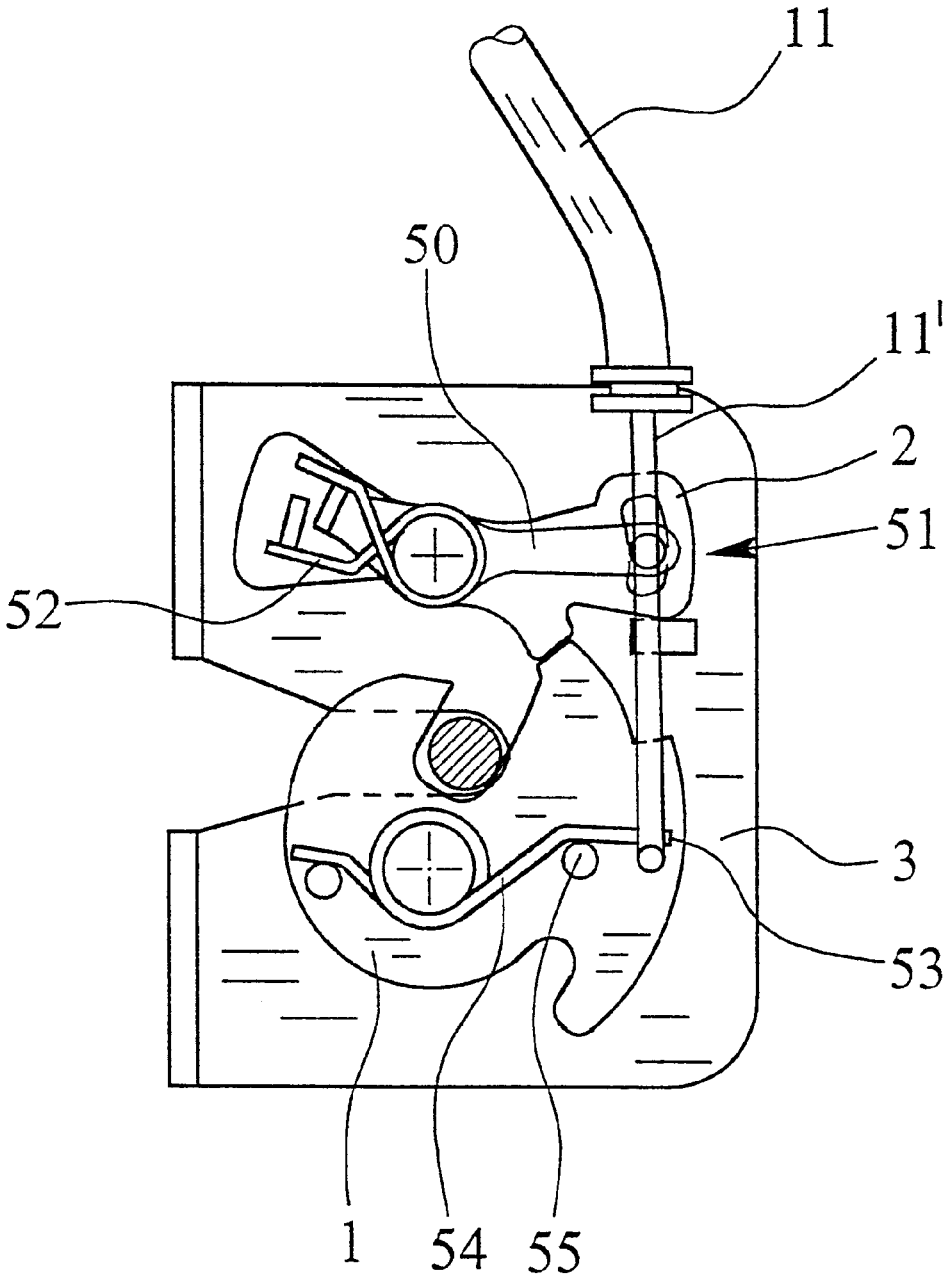
FIG. 3 shows the lock unit of another preferred embodiment of a motor vehicle door lock.

Of course, due to the concentration of electrical components in the control unit 7, the mechanical motion of the detent pawl 2 must be transferred over the distance between the lock unit 3 and the control unit 7. In this embodiment, and also in the prior art, the remote power transmission means 11 according to the preferred embodiment is in the form of a Bowden cable 11, as shown in FIG. 2, with a core 11', as shown in FIG. 3. From the combination of FIGS. 2 and 3, it can be seen that a corresponding detent pawl lever 12 pulls the core 11' of the Bowden cable 11 for actuating the detent pawl 2 so as to raise it. This takes place of course only when the control unit 7 is "cleared," and therefore, in the "unlocked" state.

FIG. 2 clearly shows the internal components of the control unit 7 of a preferred embodiment of the invention. As shown in FIG. 2, there are a Bowden cable 13 leading to an outside door handle, an outside actuation lever 14 actuated by this Bowden cable 13, and a coupling element 15. A central interlock drive has an electric drive motor 16 and a worm gear pair with a drive element 17 which can be driven in two directions. The drive element 17, in one direction, actuates an adjustment element 18 in the direction of the coupled position and the Bowden cable 11 relative to the detent pawl 2. In the opposite direction, the adjustment element 18 is actuated in the direction of the decoupled position, and the detent pawl 2 is released.

Furthermore, there is a Bowden cable 19 connected to the inside door handle, an anti-theft feature drive motor 20 with a corresponding drive element 21 and a coupling journal 22. This construction is described in greater detail in commonly owned, co-pending U.S. patent application Ser. No. 10/129,455, filed May 7, 2002, which is hereby incorporated by reference to the extent necessary to complete an understanding of this feature.

FIG. 3 shows the remote power transmission means 11, with core 11' of the Bowden cable, in the locked position. Also, the main catch position of the lock latch 1 is shown connected to the lock latch 1. Reaching the closed position or the main catch position of the lock latch 1 can be mechanically signaled by using the drawing function of the remote power transmission means 11, hence the core 11' of the Bowden cable, in the opposite direction into the control unit 7. The movement of the core 11' of the Bowden cable in the opposite direction (in the second direction) can be evaluated using circuitry in the control unit 7.

Technically, this means that the first position in the control unit 7 signifies that the detent pawl 2 is in its engaged position. The position of the end of the core 11' which is conversely spaced slightly apart in the control unit 7 signals that the lock latch 1 has now assumed its closed position as well.

As a result, the use of an electrical connecting element to the lock unit 3 can be obviated. The desired scanning of the position of the lock latch 1 can be achieved mechanically using the existing remote power transmission means 11, specifically the core 11' of the Bowden cable.

The preferred embodiment shown in FIG. 3 illustrates that the core 11' of the Bowden cable is coupled to the lock element, specifically the detent pawl, with the interposition of the detent pawl lever 50, or another intermediate element, with inclusion of a bilateral freewheel 51. The bilateral freewheel 51 allows the lock latch 1 a certain overstroke and, moreover, a trailing engagement to the detent pawl 2 when the motor vehicle door lock is closed.

The preferred embodiment shown further illustrates the detent pawl lever 50 or the like being pretensioned into a middle position by means of a spring 52. When the closed position or the main catch position is reached, the lock latch 1 can be deflected against the spring force. The middle position of the detent pawl lever 50, which is dictated by the spring 52 relative to the detent pawl 2, represents the position "detent pawl engaged". If the lock latch 1 then meets the core 11' of the Bowden cable and moves it further down in FIG. 3, the spring 52 is tensioned and the state "lock latch in the closed position" is signaled.

The desired free-wheel 51 can be implemented by using various arrangements. For example, spring elements can be interposed which divide the core 11' of the Bowden cable, etc. The embodiment shown illustrates that the free-wheel 51 was easily formed by an elongated hole-journal arrangement between the detent pawl lever 50 and the detent pawl 2. The path of the journal remaining down in the elongated hole in FIG. 3 enables a certain overstroke for the lock latch 1 and also enables trailing engagement of the detent pawl 2.

Moreover, the embodiment shown in FIG. 3 illustrates a special construction such that the core 11' of the Bowden cable is detachably connected to the lock latch 1 outside of the closed position or the main catch position. For this purpose, it is provided that the lock latch 1 has a catch element 53 in the form of the end of a spring element 54 which is supported on the lock latch 1 and which catches the end of the core 11' of the Bowden cable before reaching the closed position or the main catch position and entrains it into the position shown in FIG. 3. The spring element 54 which is made as a leg spring on a stop 55 which dictates the end position is apparent. The spring forces of the springs 54 and 52 are matched to one another and yield the desired switching and signal function with respect to the closed position of the lock latch 1.

Figure 4:
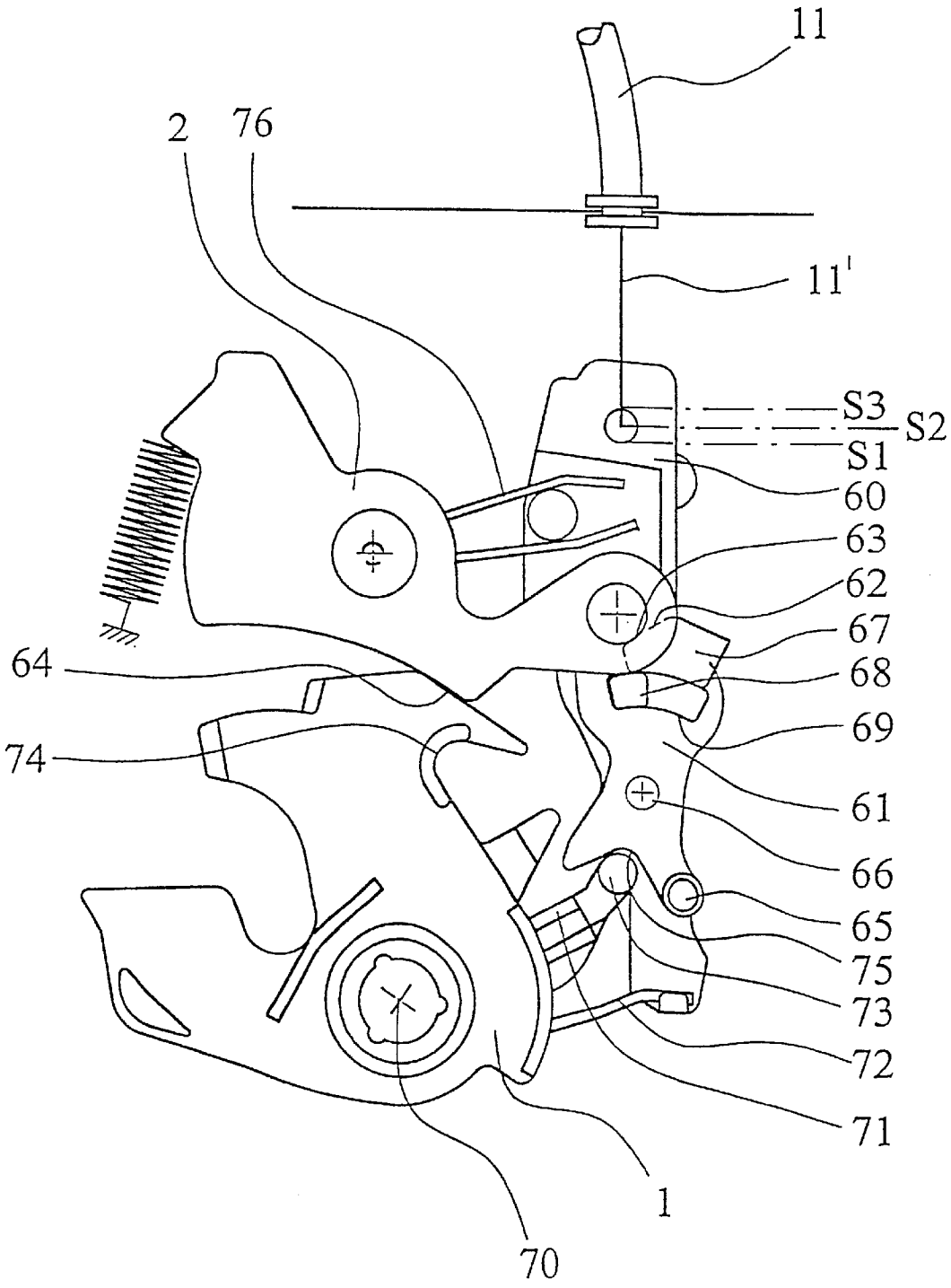
FIG. 4 schematically shows the lock unit of another preferred embodiment of a motor vehicle door lock in accordance with the invention with the lock latch in the open position.
Figure 5:
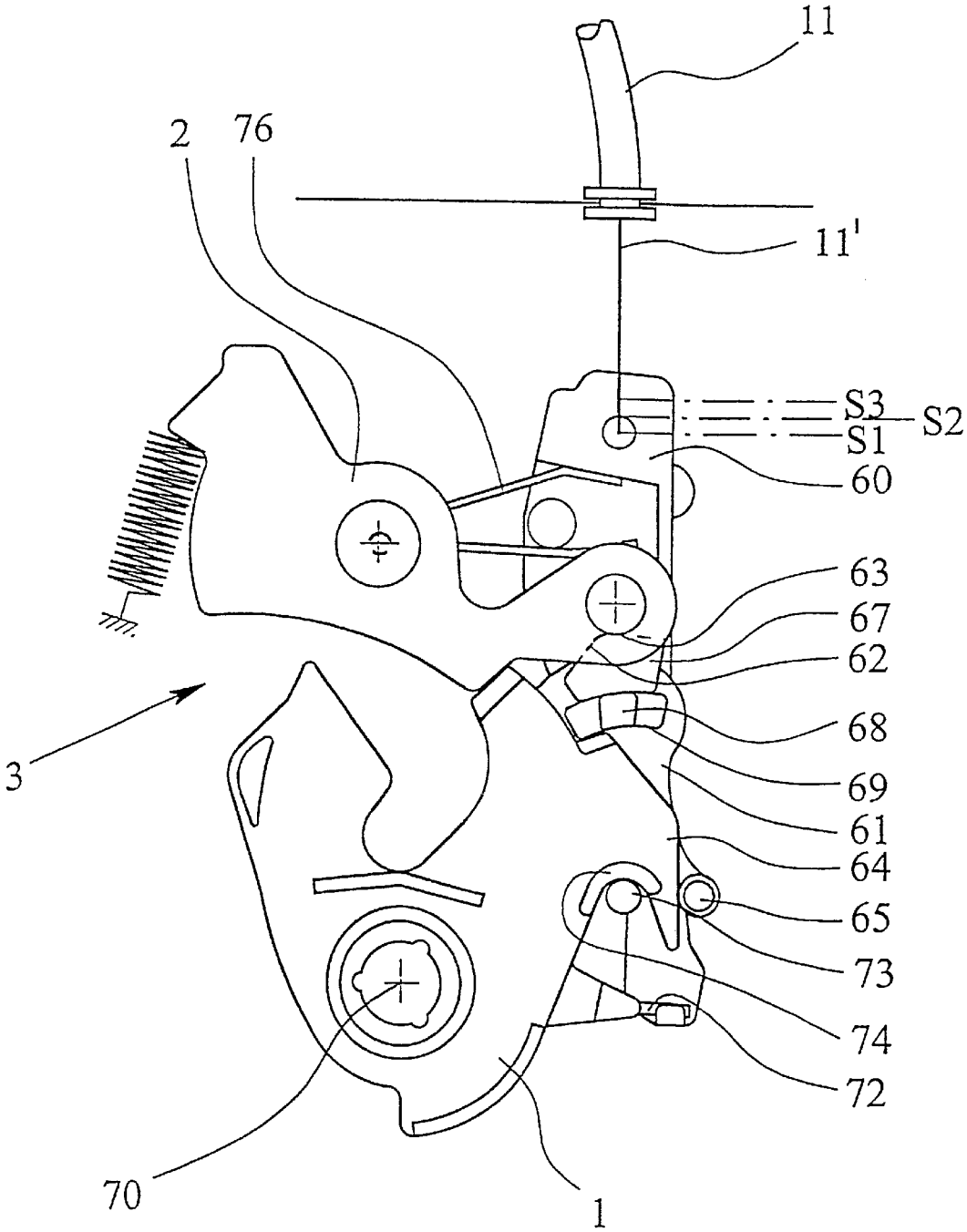
FIG. 5 shows the lock unit from FIG. 4 with the lock latch in the main catch position.

FIGS. 4 & 5 show another preferred embodiment of the motor vehicle door lock. As shown, the lock unit 3 has an adjustable transmission element 60, through which the remote power transmission means 11 is connected to the lock unit 3. For this reason first the transmission element 60 is connected to the remote power transmission means 11, especially to the core 11' of the Bowden cable. The lock latch 1 is likewise coupled to the remote power transmission means 11, especially to the core 11' of the Bowden cable, via the transmission element 60.

It should be pointed out that being coupled can mean a connection, but especially also a detachable connection. Here, "coupled" means that the remote power transmission means 11, at least in the locked position or the main catch position of the lock latch 1, is connected to the lock latch 1 via the transmission element 60.

Movement of the lock latch 1 from the preliminary catch position, which is not shown in the locked position or the main catch position in FIG. 5, causes motion of the transmission element 60 in FIG. 5 in downward direction (position S1), by which the remote power transmission means 11, especially the core 11' of the Bowden cable, is moved in the second direction. As will be shown below, this connection between the lock latch 1 and the transmission element 60 is an elastic connection so that the transmission element 60 can be moved up against the reset force of this elastic connection by a corresponding actuation of the remote power transmission means 11 in FIG. 5, therefore, in the first direction.

The aforementioned movement of the transmission element 60 in the first direction causes lifting of the detent pawl 2 via an intermediate element 61 assigned to the transmission element 60. For this purpose, the intermediate element 61 has a contact surface 62 which comes into contact with the corresponding contact surface 63 of the detent pawl 2 by the movement of the transmission element 60 in the first direction.

If, at this point, the contact surface 62 of the intermediate element 61 is located rigidly on the transmission element 60, when the lock latch 1 is in the locked position or the main catch position, the transmission element 60 would have to carry out a certain movement in the first direction (freewheel) until the contact surface 62 of the intermediate element 61 would come into contact with the contact surface 63 of the detent pawl 2. To avoid this freewheel, in a preferred embodiment, the intermediate element 61 on the transmission element 60 is made to be adjustable such that the distance of the contact surface 62 of the intermediate element 61 to the contact surface 63 of the detent pawl is adjustable. The adjustability can be structurally accomplished such that resetting takes place in such a way that a distance as small as possible of the contact surfaces 62, 63 as far as distance "zero," therefore the contact itself, is always accomplished.

The distance of two contact surfaces means the distance which must be bridged for the two contact surfaces to come into contact with one another. It is not necessary for these contact surfaces to be planar. Rather, it can be provided that one contact surface be formed by a journal, or the like, and the other contact surface by a control cam, an edge, or the like. Thus, it is such that the intermediate element 61 has a contact surface 62 which is made in cross section as a control cam and the detent pawl 2 has a contact surface 63 formed by a radius, especially by a journal.

Furthermore, the lock latch 1 and the adjustable intermediate element 61 are dynamically coupled such that the movement of the lock latch 1 from the preliminary catch position into the locked position or into the main catch position causes movement of the intermediate element 61. This dynamic coupling is made such that the contact surface 62 of the intermediate element 61 at least when the locked position or the main catch position is reached comes into contact with the contact surface 63 of the detent pawl 2. This results in that, when the lock latch 1 is in the locked position or in the main catch position, actuation of the remote power transmission means 11 in the first direction immediately causes actuation of the detent pawl 2 without the interposed free-wheel.

The aforementioned advantages are achieved especially by the distance which is effective for transmission between the transmission element 60 and the detent pawl 2 being adjustable by moving the intermediate element 61. The distance which is effective for transmission here means the distance in the adjustment direction of the transmission element 60 between a fixed point on the transmission element 60 and the respective point of application of force of the transmission element 60 to the detent pawl 2.

The dynamic coupling between the lock latch 1 and the intermediate element 61 is accomplished in an especially preferred configuration in that, on one side, the lock latch 1 has a control cam 64 and that, on the other side, the intermediate element 61 has a corresponding engagement element 65, preferably a journal or the like. When the lock latch 1 is moved into the locked position or into the main catch position, the control edge 64 of the lock latch 1 comes into contact with the engagement element 65 and moves it accordingly.

One simple and durable configuration of the intermediate element 61 arises when the intermediate element 61 is made as a lever which can swivel around the axis 66. The contact surface 62 of the intermediate element 61 is located on the lever such that by swiveling the lever the distance of the contact surface 62 to the contact surface 63 of the detent pawl 2 is adjustable. In the simplest configuration, on the intermediate element 61 there is an element 67 which is wedge-shaped or step-shaped in cross section. In the wedge-shaped configuration element 67 has a base and an oblique surface, the base surface being located essentially tangentially to the axis 66 and its oblique surface forming the contact surface 62. By swiveling the intermediate element 61 the wedge-shaped element 67 can be moved depending on the position of the transmission element 60 to "under" the contact surface 63 of the detent pawl 2. In the step-shaped configuration, on the other hand, a step on the element 67 forms the contact surface 62 of the intermediate lever 61 which in turn can be pushed to under the contact surface 63 of the detent pawl 2. FIG. 5 shows the state in which the step of the element 67 is located under the contact surface 63 and is in contact with it.

Depending on the configuration of the contact surface 62 of the intermediate element 61, the latter has a practical range of motion. In one preferred configuration, on the transmission element 60 and/or on the intermediate element 61 there is a limitation arrangement which likewise limits the adjustment motion of the intermediate element 61. In this embodiment, on the transmission element 60 there is a pin 68 in a slot 69 in the intermediate element 61.

For coupling between the lock latch 1 and the adjustable transmission element 60, there is an especially advantageous configuration. For this reason, a driver 71 which can be pivoted around an axis 70 is coupled via a spring 72 to the transmission element 60. The lock latch 1 can be engaged with the driver 71 such that when the lock latch 1 is moved from the preliminary catch into the closed position or into the main catch position, the driver 71 in FIG. 5 is swung to the right, and in this fashion, an actuation force acts via the spring 72 in the second direction on the transmission element 60. As a result, the transmission element 60 is moved in the second direction. This movement, as described above, is relayed via the remote power transmission means 11, especially via the core 11' of the Bowden cable, to the control unit 7. Coupling between the lock latch 1 and the driver 71 is achieved by the driver 71 having a journal 73 which when the lock latch 1 is moved into the locked position or into the main catch position is grasped by the hook-shaped piece 74 of the lock latch 1 and is accordingly entrained. In this way, the spring 72 is tensioned and the transmission element 60 displaced accordingly.

In a preferred embodiment, the driver 71 has an additional function, specifically to drive the intermediate element 61 into a certain base position when the lock latch 1 is in the preliminary catch position or in the open position shown in FIG. 4. For this purpose, the intermediate element 61 has a shaped part 75 into which the driver 71 with the journal 73 fits in the aforementioned arrangement. Preferably, the limiting means 68, 69, i.e., pin and slot, respectively, then exert a force which is opposite the driving force of the driver 71 on the intermediate element 61 so that, overall, a stable equilibrium state is achieved. This ensures that even when the lock latch 1 is not in direct contact with the intermediate element 61, the intermediate element 61 is still fixed in a defined position, the base position.

For the adjustability of the transmission element 60, a series of possibilities is conceivable. In addition to being able to pivot, in particular, an ability to move lengthwise is especially advantageous when direct coupling between the remote power transmission means 11 is considered, especially between the core 11' or the Bowden cable and the transmission element 60. In order to ensure resetting of the transmission element 60 into a defined base position after each movement, in one preferred embodiment, it is furthermore provided a spring 76 coupled to the transmission element 60 and likewise assumes this function.

It should be pointed out that the embodiment shown in FIGS. 4 & 5 can also be provided with a free-wheel shown in FIG. 3.

What is claimed is:

1. Motor vehicle door lock, comprising:

a lock unit containing mechanical lock elements including a lock latch and a detent pawl, and a lock mechanism with a plurality of interacting elements in a control unit which is separated from the lock unit, wherein the lock unit is arranged spatially separated from the control unit at a motor vehicle door or hatch, wherein the lock unit is connected to the control unit by means of a remote power transmission means, and wherein the detent pawl in the lock unit is mechanically actuated from an element of the lock mechanism in the control unit by means of a drawing of the remote power transmission means in a first direction, wherein the remote power transmission means, at least between an advanced position of the lock latch slightly before a closed position of the lock latch and the closed position of the lock latch, is also connected to the lock latch, wherein the lock latch by moving from the advanced position into the closed position is drawing the remote power transmission means in a second direction that is opposite said first direction, wherein the remote power transmission means mechanically signals the control unit when the lock latch reaches the closed position, and wherein the control unit comprises means for sensing motion of the remote power transmission means in said second direction.

2. The motor vehicle door lock as claimed in claim 1, wherein the remote power transmission means is a Bowden cable having a core coupled to the detent pawl via an intermediate element with inclusion of a bilateral free-wheel.

3. The motor vehicle door lock as claimed in claim 2, wherein said intermediate element is a detent pawl lever.

4. The motor vehicle door lock as claimed in claim 3, wherein the detent pawl lever is pre-tensioned into a middle position by means of a spring, and is deflectable against the spring pre-tensioning when the closed position of the lock latch is reached.

5. The motor vehicle door lock as claimed in claim 3, wherein the free-wheel is formed by an elongated hole-journal arrangement between the detent pawl lever and the detent pawl.

6. The motor vehicle door lock as claimed in claim 1, wherein the lock latch has a catch element in the form of the end of a spring element which is supported on the lock latch and which catches an end of the remote power transmission means, before reaching the closed position, and entrains it.

7. The motor vehicle door lock as claimed in claim 1, wherein the lock unit has an adjustable transmission element connected to the remote power transmission means, wherein the remote power transmission means, at least in the closed position of the lock latch, is connected via the transmission element to the lock latch and is displaceable in said second direction, wherein the transmission element has an adjustable intermediate element with a contact surface, wherein the transmission element, by moving in the first direction, brings a contact surface of the intermediate element into contact with a contact surface of the lock element for actuation of the lock element, wherein the distance between the contact surface of the intermediate element and the contact surface of the lock element is adjustable by moving the intermediate element on the transmission element, and wherein the lock latch and the intermediate element are dynamically coupled, and by the dynamic coupling, movement of the lock latch from a preliminary catch position into the closed position causes motion of the intermediate element such that the contact surface of the intermediate element contacts the contact surface of the lock element, at least when the closed position is reached.

8. The motor vehicle door lock as claimed in claim 7, wherein a length which is effective for transmission between the transmission element and the detent pawl is adjustable by moving the intermediate element.

9. The motor vehicle door lock as claimed in claim 7, wherein the lock latch has a control edge, wherein the intermediate element has an engagement element, and wherein the dynamic coupling between the lock latch and the intermediate element is produced by the contact of the engagement element with the control edge.

10. The motor vehicle door lock as claimed in claim 7, wherein the intermediate element is a lever which can be pivoted around an axis on the transmission element, and the contact surface of the intermediate element is located on the lever such that the distance of the contact surface of the intermediate element to the contact surface of the lock element is adjustable by pivoting the lever.

11. The motor vehicle door lock as claimed in claim 7, wherein the contact surface of the intermediate element is formed by a wedge-shaped or step-shaped element located on the intermediate element.

12. The motor vehicle door lock as claimed in claim 7, wherein a limitation arrangement is provided on at least one of the transmission element and the intermediate element, said limitation arrangement limiting the motion of the intermediate element relative to the transmission element.

13. The motor vehicle door lock as claimed in claim 7, wherein a driver is provided which is pivotable around an axis for coupling between the lock latch and the transmission element, wherein the driver is coupled via a spring to the transmission element, wherein the lock latch is engageable to the driver such that, when the lock latch is moved from the preliminary catch position into the locked position, the driver is pivoted in a manner causing an actuating force to be exerted in the second direction on the transmission element via the spring.

14. The motor vehicle door lack as claimed in claim 13, wherein the intermediate element has a shaped piece, and the driver, when the lock latch is in the preliminary catch position or open position, fits into the shaped piece such that the intermediate element, is fixed in a base position.

15. The motor vehicle door lock as claimed in claim 7, wherein the transmission element is moveable lengthwise.

16. The motor vehicle door lock as claimed claim 7, wherein a spring is provided for fixing the transmission element in a base position, and wherein the transmission element is deflectable against a reset force of the spring in the first and the second direction.

17. The motor vehicle door lock as claimed claim 1, wherein lock electronics are provided in the control unit, and wherein the remote transmission means comprises a Bowden cable.

* * * * *